United States Patent [19]

Vollmar

[11] Patent Number: 4,508,043

[45] Date of Patent: Apr. 2, 1985

[54] PRESSER FOOT DEVICE ON A SEWING MACHINE

[75] Inventor: Kurt Vollmar, Weilerbach, Fed. Rep. of Germany

[73] Assignee: Pfaff Industriemaschinen GmbH, Fed. Rep. of Germany

[21] Appl. No.: 550,194

[22] Filed: Nov. 9, 1983

[30] Foreign Application Priority Data

Nov. 18, 1982 [DE] Fed. Rep. of Germany ..... 3242509

[51] Int. Cl.[3] ..... D05B 29/02

[52] U.S. Cl. ..... 112/235

[58] Field of Search ..... 112/235, 237, 238, 60, 112/61

[56] References Cited

U.S. PATENT DOCUMENTS

| | | | |
|---|---|---|---|
| 4,323,020 | 4/1982 | Thompson | 112/237 X |
| 4,381,722 | 5/1983 | Takeuchi et al. | 112/235 |

FOREIGN PATENT DOCUMENTS

| | | | |
|---|---|---|---|
| 2942166 | 4/1981 | Fed. Rep. of Germany | 112/235 |
| 3119716 | 11/1982 | Fed. Rep. of Germany | 112/235 |
| 3132044 | 3/1983 | Fed. Rep. of Germany | 112/235 |

*Primary Examiner*—H. Hampton Hunter

*Attorney, Agent, or Firm*—McGlew & Tuttle

[57] ABSTRACT

A presser foot device on a sewing machine has a swingingly driven foot which can be shifted by two compressed air cylinders and piston combination and a spring mechanism into an inoperative position and, for adaptation to different work thicknesses, into a plurality of operating ranges, each with a different height position but constant amplitude of oscillation.

8 Claims, 3 Drawing Figures

PRESSER FOOT DEVICE ON A SEWING MACHINE

FIELD AND BACKGROUND OF THE INVENTION

This invention relates in general to sewing machines and in particular to a new and useful drive for a presser foot which makes it possible to drive it in a plurality of vertically different operating ranges.

A presser foot device similar to the present invention is described in German OS No. 25 07 544. The swingingly driven presser bar has attached to it a projection with which each downward stroke impinges on an abutment element. Through a second compressed air cylinder, the abutment element can be moved between two different height positions, whereby the lower dead center of the oscillation of the foot can be adapted to different sewing conditions as for instance work thickness, type of stitch formation, etc. However, when raising the abutment element only the lower dead center of the oscillation of the foot is displaced and thus the swinging range of the foot is narrowed. Therefore the known presser foot device is suitable only for limited height adaptations.

For some sewing jobs, e.g. in shoe manufacture, there occur during the sewing at cross seams and at transition points of overlapping work parts such different work thicknesses that a two-step adjustment of the lower dead center of the foot is too imprecise. Since the downward movement of the presser bar is decelerated abruptly when the projection strikes the abutment element and therefore great impact forces occur, the known presser device can further be used only for slow running sewing machines.

SUMMARY OF THE INVENTION

The invention provides a presser foot device wherein the lower dead center position of the foot can be shifted in a multi-step operation while maintaining its oscillation amplitude constant.

By designing an abutment element as a lever which limits the stroke of the piston rods of two compressed air cylinders, which lever serves also as a positioning element for varying the height position of an output element of oscillatory drive for the foot, the movement path of the output element and hence the swinging range of the foot is neither reduced nor increased but is merely shifted in height. As this does not affect the kinematics of the swinging motion of the foot, the presser foot device is suitable without restriction also for high-speed sewing machines.

By the further measure of using as a second compressed air cylinder, a double-action cylinder and providing a spring mechanism which holds the piston in an intermediate position when the cylinder is vented, it is achieved that with only two parallel compressed air cylinders an inoperative position and three operating regions, each with a different height position, can be set.

Accordingly, it is an object of the invention to provide a device for driving a presser foot of a sewing machine so that it may shifted vertically in a plurality of vertical operating ranges without disturbing its drive through an oscillating member and a toggle mechanism.

A further object of the invention is to provide a sewing machine presser foot drive which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
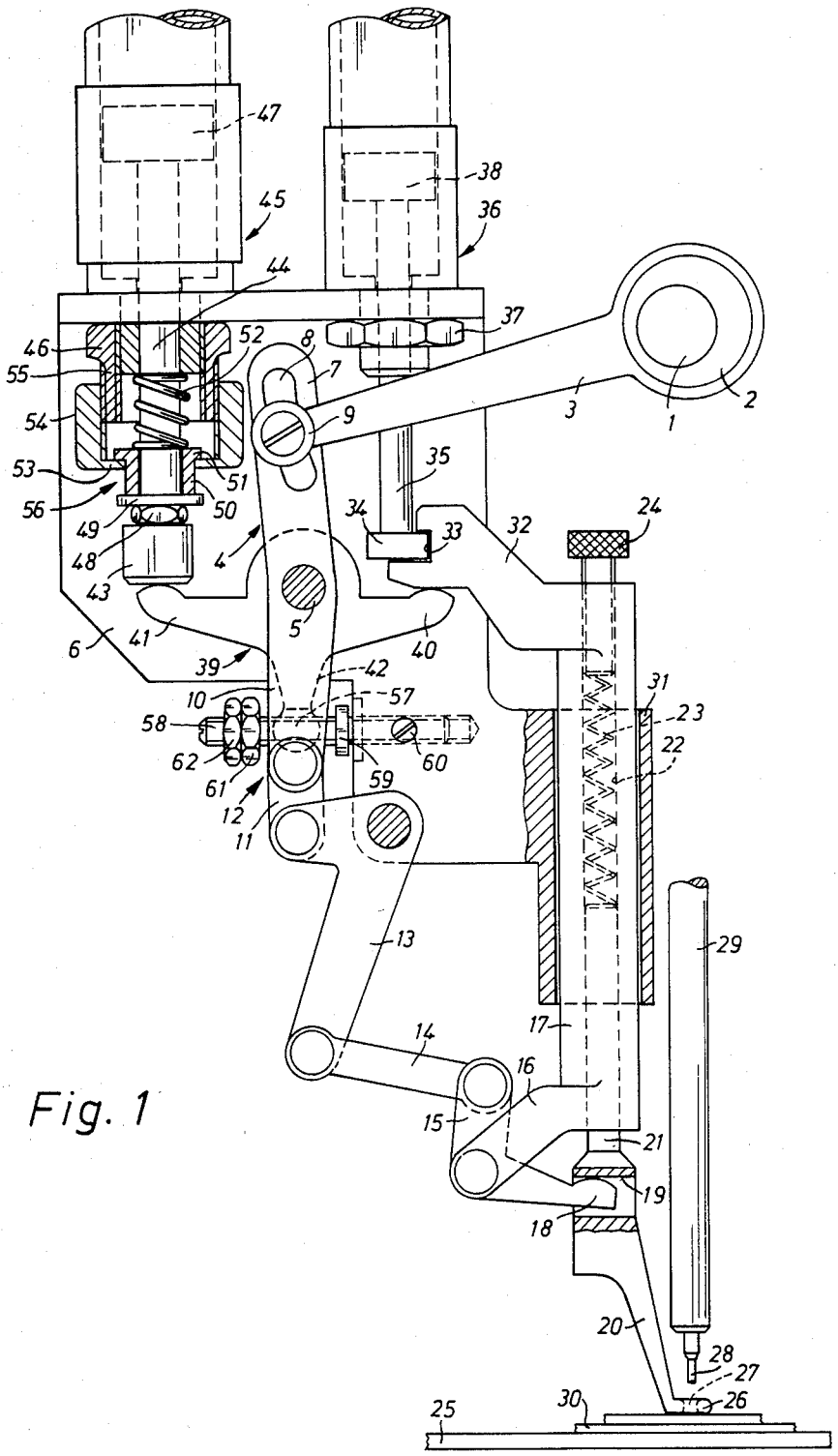
FIG. 1 is a partial sectional view of the presser foot device in the middle position.

Referring to the drawings, in particular the invention embodied therein comprises a control system for varying the elevational height of movement of a presser foot 20 and is moved downwardly and upwardly to engage and disengage a workpiece 30 to be sewn from the main shaft 1 of the sewing machine which causes the oscillation of a double lever generally designated 4 and the operation of a toggle mechanism generally designated 12 which moves the presser foot 20 upwardly and downwardly. In accordance with the invention both the bottom dead center position of the presser foot 20 and its elevational movement range is controlled by two compressed air cylinder and piston combinations which act on a control member in the form of a lever 30 which is pivotally mounted on the sewing machine and engages an arm 32 carrying the presser foot 20. The construction includes a spring mechanism for one of the cylinder and piston combinations to hold it in an intermediate position when the cylinder is vented. The arrangement permits working in a plurality of operating ranges each with a different height position but constant amplitude of oscillation.

In the housing of the sewing machine is mounted a main shaft 1 which, via an eccentric 2 and an eccentric rod 3, drives a double lever 4. The double lever 4 is mounted on a stud 5 which is mounted in a plate 6 firmly connected with the housing. Double lever 4 has an arm 7 with an arc-shaped slot 8, in which the point of articulation of the eccentric rod 3 can be adjusted with a collar screw 9. The other arm 10 of double lever 4 forms with a link 11 a toggle joint mechanism 12 which is connected with an angle lever 13 likewise mounted on plate 6. The angle lever 13 is connected via a substantially horizontal link 14 with an additional angle lever 15 which is mounted on a projection 16 of presser bar 17. Angle lever 15 has a crowned tappet 18 which engages from below an abutment surface 19 of a foot 20. Foot 20 is provided with a guide rod 21 which is guided inside a bore 22 in the presser bar 17 and is under the action of a spring 23. The pressure of spring 23 can be varied by a set screw 24 screwed into the upper end of the presser bar 17.

Foot 20 comprises a presser sole 26 cooperating with a throat plate 25 of the sewing machine and equipped with a passage hole 27 for a needle 28. Needle 28 is attached to a needle bar 29, which is driven by the main shaft 1 in known manner, not shown. It cooperates with a looper or shuttle also not shown, mounted below the throat plate 25, to form a seam in the work 30 lying on the throat plate 25.

Presser bar 17 is displaceably mounted in a bushing 31 firmly connected with plate 6 and comprises an arm 32. At the free end of arm 32 a recess 33 is formed, into which a tappet 34 protrudes. The tappet 34 is arranged on a piston rod 35 of a double-action compressed air cylinder 36. Cylinder 36 is secured to plate 6 by a nut 37 and has a piston 38 therein.

On stud 5 is mounted a lever 39 with three arms 40, 41, 42. Arm 40 engages arm 32 of the presser bar 17 from below. On arm 41 rests a pressure piece 43 which is arranged on the piston rod 44 of a double-action compressed air cylinder 45. Cylinder 45 is secured on plate 6 by a nut 46 and has a piston 47. On piston rod 44 an abutment disc 49 is fastened with a nut 48 and a displaceable sleeve 50 having a collar 51 is provided. A compression spring 52 fitted on piston rod 44 presses sleeve 50 by its collar 51 against an end wall 53 of an adjusting ring 54 which is screwed on a threaded shoulder 55 of nut 46. Sleeve 50, compression spring 52, adjusting ring 54 and abutment disc 49 form a spring mechanism 56.

The free end of arm 42 of lever 39 is formed as a forked head 57 and engages around a threaded pin 58 disposed in plate 6. Pin 58 has a collar 59 serving as abutment for the forked head 57 and is secured against rotation by a screw 60. In addition, the threaded pin 58 carries two nuts 61, 63 screwed one against the other, which also serve as abutment for the forked head 57.

The sewing machine operates as follows:

When the work 30 is placed on the throat plate 25, piston 38 of the compressed air cylinder 36 is moved upward, whereby arm 32 of presser bar 17 is lifted off arm 40 of lever 39 and foot 20 is raised into an inoperative position. After the work 30 has been placed on, the compressed air cylinder 36 is admitted in the opposite direction and hence position 38 is moved downwardly, owing to which arm 32 comes down on arm 40.

If the work 30 requires the middle position of the presser foot device as shown in FIG. 1, the compressed air cylinder 45 remains vented on both sides. In this case, sleeve 50 applies by its collar 51 against the end wall 53 of the adjusting ring 54 under the action of compression spring 52. The downwardly pressing piston 38 of cylinder 36 holds arm 41 in contact with the pressure piece 43, the abutment disc 49 applying against sleeve 50. The characteristic of compression spring 52 is such that the torque produced by it at lever 39 is greater than the torque produced by cylinder 36. In this manner lever 39 in conjunction with the spring mechanism 56 forms for arm 32 an abutment which determines the height position of the presser bar 17 in the operative position. The height position of presser bar 17 can be adjusted exactly by turning the adjusting ring 54.

During operation of the sewing machine, the eccentric 2 causes the tappet 18 to oscillate by way of the eccentric rod 3, double lever 4, link 11, angle lever 13, link 14 and angle lever 15. In this way, foot 20, supported on tappet 18, executes a vertical oscillation, during which, when needle 28 is inserted in work 30, it rests lightly on the work, and when needle 28 is outside the work, it is raised away from the work 30. The lower oscillatory position foot 20 is to permit the thread looping during stitch formation and is to hold the work 30 flat on the throat plate 25 as needle 28 pulls back. In the upper oscillatory position, foot 20 is to be raised off the work 30 just far enough for the work, held for example in a movable clamp, to be transported without hindrance.

Figure 3:
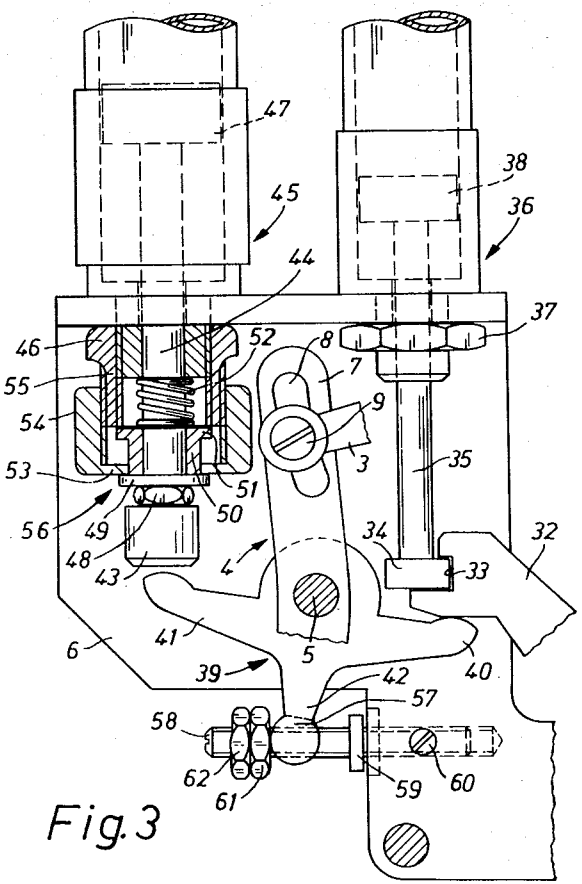
FIG. 3 is a partial sectional view of the two compressed air cylinders and of the spring mechanism in the lower shift position.

If the work 30 is thin, piston 47 of cylinder 45 is admitted from the bottom side, whereupon piston rod 44 together with sleeve 50 is raised counter to the force of the compression spring 52 until the abutment disc 49 strikes against the end wall 53 of the adjusting ring 54. As a result, the compressed air cylinder moves the presser bar 17 downward until the forked head 57 of lever 39 moving clockwise hits against nut 61 according to FIG. 3. By the lowering of the presser bar 17, the oscillation range of foot 20 is displaced downward without changing the amplitude of oscillation and is thus adapted to thin work 30. The height position of the oscillation range of foot 20 can be adjusted exactly by displacement of the two nuts 61, 62.

Figure 2:
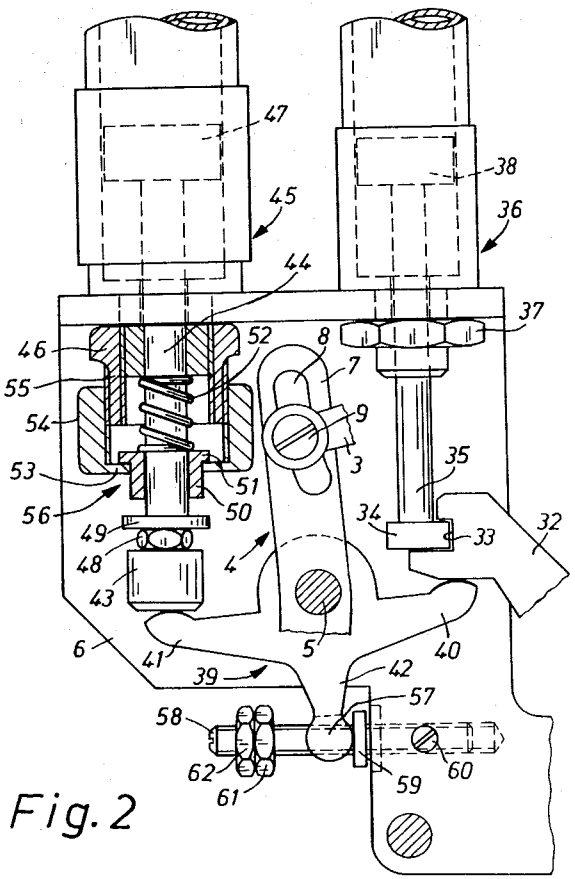
FIG. 2 is a partial sectional view of the two compressed air cylinders and of the spring mechanism in the upper shift position.

If the work is very thick or if thickened portions are encountered in sewing, e.g. at the transitions of overlapping work plies, it may be necessary to move the presser foot device into the upper shift position. In this case piston 47 of cylinder 45 is admitted from the top, whereupon piston rod 44 is moved downward, in so doing, lever 39 is pivoted counterclockwise, and as a result thereof the presser bar 17 is moved upward counter to the force of cylinder 36, until the forked head 57 of lever 39 strikes against collar 59 according to FIG. 2. For the execution of this shifting process, the torque produced by cylinder 45 at lever 39 must be greater than the torque produced by cylinder 36. By the raising of presser bar 17, the oscillation range of foot 20 is shifted upward without changing the amplitude of oscillation and is in this way adapted to thick work 30 or to thickened portions of the work. The height position of the oscillation range of foot 20 can be adjusted exactly by turning the threaded pin 58.

While a specific embodiment of the invention has been shown and described in detail to illustrate the application of the principles of the invention, it will be understood that the invention may be embodied otherwise without departing from such principles.

What is claimed is:

1. A presser foot device on a sewing machine having a reciprocating presser foot, an oscillating drive for said presser foot which includes a toggle mechanism having an output member connected to the presser foot for moving it downwardly and upwardly to engage and disengage from the material to be sewn and which is connected to the presser foot for effecting vertical oscillations synchronously with the stitch formation, and wherein the presser foot is movable by a first compressed air cylinder and piston combination between an inoperative and an operative position, comprising a second air cylinder and piston combination adjacent the presser foot, a movable abutment element carried on said machine which is engaged by said second compressed air cylinder and piston combination for adjusting the lowered position of the foot, said abutment element comprising a lever engaged with the piston rods of said first and second piston and cylinder combinations which is pivotally mounted and acts on said presser foot for varying the height postion of the output element of the oscillating drive, said second compressed air cylinder and piston combination comprising an double-action cylinder, and spring means holding said piston of said second piston and cylinder combination in intermediate position when said second cylinder is vented.

2. A presser foot device according to claim 1, wherein said spring mechanism comprises a sleeve having a collar displaceable on said piston of said second cylinder combination in an adjusting ring engaged over said sleeve and around said collar, said collar being engaged against an end wall of said adjusting ring, and a strike disc secured on said piston rod below said sleeve and secured to said piston rod.

3. A presser foot according to claim 2, wherein said lever comprises an arm which is movable between two adjustable stops.

4. In a sewing machine which includes a reciprocating needle adapted to move into and out of engagement with a workpiece and which includes a presser foot which reciprocates outwardly into and out of engagement with the workpiece to be sewn and a drive member which is oscillated by the sewing machine drive which is connected through an angle lever of a toggle mechanism to the presser foot for moving it, the improvement comprising a control member movably mounted adjaceent said presser foot and engageable with said presser foot and being movable to shift said presser foot to adjust the lower dead center position of said presser foot and to move the presser foot between an operative and inoperative position, and fluid pressure means acting on said control member for varying the position thereof.

5. In a sewing machine according to claim 4, wherein said control member comprises a lever pivotally mounted between its ends adjacent the presser foot and including a first lever arm portion engageable with the presser foot and a second lever arm portion, said fluid pressure means including a first fluid pressure operated piston and cylinder combination operating on said first lever arm portion to move said lever arm portion to pivot said lever and move the presser foot between its operative and inoperative position, and a second fluid pressure operated piston and cylinder combination operating on said second lever arm portion for varying the position of said pressure foot during oscillation, said second piston and cylinder combination comprising a cylinder having a double-action piston therein, and spring means holding it in a neutral position when said cylinder is vented.

6. In a sewing machine according to claim 5, including a presser bar, the presser foot being reciprocal within the presser bar, adjustable spring means bearing on said presser foot in said bar biasing said presser foot in a downward direction, said bar having an arm portion engaging said control lever first arm portion.

7. In a sewing machine according to claim 6, wherein said control member lever includes an intermediate third arm portion, means guiding said third arm portion between two stop limits.

8. In a sewing machine according to claim 7, wherein said means guiding said third control arm portion includes a pin, said third arm including a fourth engaged over said pin and adjustable stop means on said pin on each side of said forked head portion.

* * * * *